United States Patent [19]

Lephardt

[11] Patent Number: 4,836,378

[45] Date of Patent: Jun. 6, 1989

[54] PACKAGE HAVING MAGNETICALLY CODED TEAR TAPE OR SEALING STRIP

[75] Inventor: John O. Lephardt, Mechanicsville, Va.

[73] Assignee: Philip Morris, Incorporated, New York, N.Y.

[21] Appl. No.: 122,229

[22] Filed: Nov. 18, 1987

[51] Int. Cl.[4] ..... B65D 75/58; B07C 5/00

[52] U.S. Cl. ..... 206/459; 206/264; 206/606; 206/613; 206/818; 209/536; 209/569; 209/583; 283/81; 283/82; 428/900

[58] Field of Search ..... 206/605, 459, 606, 602, 206/607, 818, 610, 613, 616, 624, 633, 631, 632, 611, 264; 283/82, 109, 81; 209/535, 536, 569, 583; 428/35, 43, 900; 156/250, 235

[56] References Cited

U.S. PATENT DOCUMENTS

| | | | |
|---|---|---|---|
| 1,808,046 | 6/1931 | Kuchenmeister . | |
| 2,781,019 | 2/1957 | Tiger . | |
| 2,782,043 | 2/1957 | Andrews . | |
| 2,797,370 | 6/1957 | Bennett | 206/818 X |
| 2,835,993 | 5/1958 | Whitehead . | |
| 2,950,971 | 8/1960 | Lewin . | |
| 2,955,896 | 10/1960 | Fritzinger . | |
| 3,023,123 | 2/1962 | Colwill et al. . | |
| 3,083,904 | 4/1963 | Brenner et al. | 206/459 X |
| 3,108,824 | 10/1963 | Fischer et al. . | |
| 3,239,841 | 3/1966 | Henkes, Jr. . | |
| 3,387,736 | 6/1968 | Williamson | 206/269 X |
| 3,426,959 | 2/1969 | Lemelson . | |
| 3,497,411 | 2/1970 | Cheboniak | 428/900 X |
| 3,519,193 | 7/1970 | Palmer | 206/616 X |
| 3,601,913 | 8/1971 | Pollock . | |
| 3,641,313 | 2/1972 | Watson . | |
| 3,641,319 | 2/1972 | McGuire . | |
| 3,662,156 | 5/1972 | Grosbard . | |
| 3,684,869 | 8/1972 | Reiter | 428/43 X |
| 3,729,203 | 4/1973 | Kinard . | |
| 3,746,606 | 7/1973 | Chao | 283/82 X |
| 3,790,757 | 2/1974 | Shaw . | |
| 3,801,750 | 4/1974 | Beaumont . | |
| 3,810,246 | 5/1974 | Stone, Jr. et al. . | |
| 3,812,538 | 5/1974 | Stone, Jr. et al. . | |
| 3,895,220 | 7/1975 | Nelson et al. | 283/82 X |
| 3,949,501 | 4/1976 | Andrews et al. . | |
| 3,955,295 | 5/1976 | Mayer . | |
| 3,975,569 | 8/1976 | Sugimatsu et al. . | |
| 3,983,276 | 9/1976 | Matsumoto | 428/900 X |
| 4,018,947 | 4/1977 | Stone, Jr. . | |
| 4,092,526 | 5/1978 | Beck . | |
| 4,135,032 | 1/1979 | Akashi et al. . | |
| 4,180,207 | 12/1979 | Lee . | |
| 4,400,457 | 8/1983 | Johnson . | |
| 4,423,415 | 12/1983 | Goldman . | |
| 4,492,993 | 1/1985 | Otis . | |
| 4,511,616 | 4/1985 | Pitts et al. | 283/82 X |
| 4,544,184 | 10/1985 | Freund et al. | 283/82 X |
| 4,631,222 | 12/1986 | Sander | 283/82 X |
| 4,631,223 | 12/1986 | Sander | 283/82 X |

*Primary Examiner*—Stephen Marcus
*Assistant Examiner*—Bryon Gehman
*Attorney, Agent, or Firm*—Donald E. Degling

[57] ABSTRACT

A novel tear strip or sealing strip for a package or container is disclosed. The tear strip or sealing strip comprises a plastic film substrate upon which a magnetizable metal oxide coating has been deposited. The coated strip may be adhered to the package or the flexible wrapping material for the package or container. Optionally, the strip may be coated with a pigment or metallized or printed with graphic indicia or any combination of these features. Information may be recorded on the magnetic coating during packaging and handling for subsequent readout.

23 Claims, 3 Drawing Sheets

PACKAGE HAVING MAGNETICALLY CODED TEAR TAPE OR SEALING STRIP

BACKGROUND OF THE INVENTION

1. Field of the Invention

The present invention relates to packaging for consumer products. More particularly it relates to packaging incorporating a magnetic tear tape or sealing strip upon which appropriate information may be encoded and read without opening or otherwise damaging the package. The invention is particularly useful for packaged consumer products such as food products and packs of cigarettes.

2. Description of the Prior Art

Consumer products have long been packaged in paper or cardboard packages which are suitably printed so as to identify the product and to provide instructions or other desirable information to the customer. Such packages now frequently display a printed bar code capable of being read by a laser device.

In order to maintain the integrity of the package and to protect the freshness of the product, the paper or cardboard package may be further wrapped with a clear plastic film material which may also bear printed information. For the convenience of the consumer it has long been common to provide a tear strip or tear tape on the plastic film material covering the package. The tear strip or tear tape may be formed from plastic material or a metallic foil and is frequently of a contrasting color. Various forms of tear strips are shown, for example, in Lemelson U.S. Pat. No. 3,426,959.

The art has also developed magnetic tapes which comprise a metal oxide coating on a plastic backing material. The metal oxide coatings are usually brown or black in color while typically the backing material is transparent. Such magnetic tapes have been used to record audio or video signals.

The ability of magnetic tape to record and store information for subsequent read-out has led to its use on credit cards, identification cards, bank cards and the like that are designed to be used with various magnetic reading devices. The use of a colorless oxide coating in combination with an identification card carrying photographic and printed information is disclosed in Mayer U.S. Pat. No. 3,955,295.

In order to identify segments of magnetic tape used to record, for example, audio signals the art discloses the concept of printing indicia such as diagonal lines on the backing material (see Tiger U.S. Pat. No. 2,781,019 and Andrews U.S. Pat. No. 2,782,043). Kinard U.S. Pat. No. 3,729,203 discloses marking the backing material of a reel of magnetic tape to indicate which track is playing while Beaumont U.S. Pat. No. 3,801,750 discloses printing a mark on the non-magnetic face of the tape to indicate a pause between recorded segments. Edge marking of magnetic tape for the same purpose is disclosed in Stone, Jr. et al. U.S. Pat. Nos. 3,810,246, 3,812,538 and 4,018,947. Akashi et al. U.S. Pat. No. 4,135,032 discloses a magnetic tape having a coating on the nonmagnetic side which can easily be marked by a black or dark colored marking device.

SUMMARY OF THE INVENTION

In accordance with the present invention applicant provides a tear tape or sealing strip for a plastic or paper container or an outer wrapping used in conjunction with a package for consumer products. The tape or strip preferably is formed from a plastic film substrate upon which a magnetizable metal oxide coating has been deposited on one or both sides. The substrate of the tape or strip may itself be colored or the coated tape or strip may be laminated to a colored lamina or laminas so as to harmonize with, or contrast with, the package. Prior to or during the packaging process, or thereafter, any desired information relating to the packaged product may be recorded in the magnetic coating of the tape or strip and such information may be read at a later time when it is desired to retrieve the recorded information. Preferably, the tape or strip is constructed so as to be symmetrical with respect to the substrate or the magnetic coating so that if the tape or strip should be twisted prior to lamination to the outer wrapping or application to the package it will still function as intended.

DESCRIPTION OF THE DRAWINGS

Further advantages of the present invention will become apparent from the following detailed description of the invention and the accompanying drawings in which.

DETAILED DESCRIPTION OF THE INVENTION

In the case of many mass produced packaged consumer goods, such as food products or packs of cigarettes, it may be important to be able to determine certain information concerning the product and its package over the life of the packaged product. Such information may include the source of the product, the machine or plant in which the product was manufactured, the date and time of manufacturing or packaging, the date of shipment to a warehouse, and the date of shipment to a retail distributor or dealer.

It will be appreciated that information of the type outlined above would be valuable in the analysis of manufacturing and distribution problems relating to consumer products. It will also be apparent that it would be beneficial to be able to determine such information without opening the package and thereby rendering the product unsaleable.

Since the type of information which may be sought frequently is determined at different times and places, it is a requirement that the information carrying medium be amenable to sequential coding of information. Also, it is important that the earlier coded information may be read and that additional information may subsequently be coded onto the information carrying medium. Another requirement of the system is that it not destroy the aesthetics of the package. Finally, since the coded information need not be readily available to the casual customer, non-visible or non-printed forms of information recordation may be employed.

Figure 1:
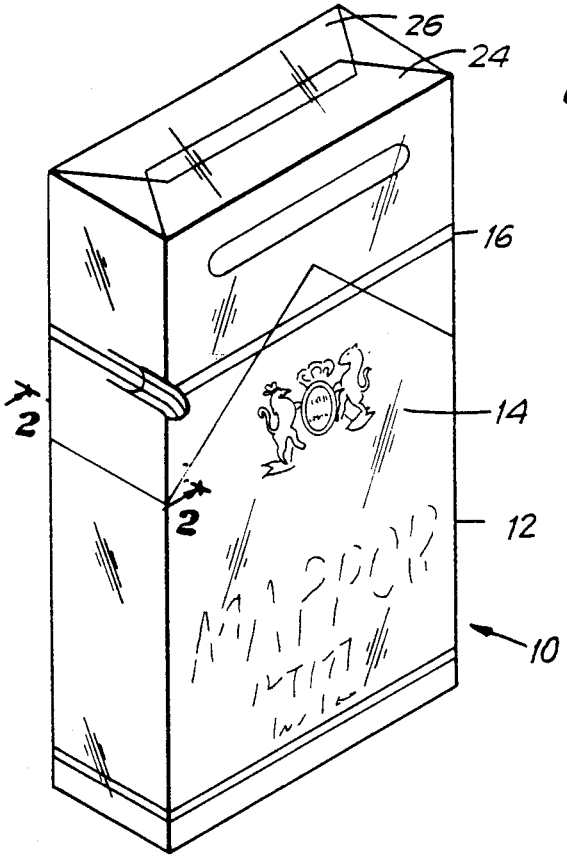
FIG. 1 is a perspective view of a package in accordance with the present invention incorporating a tear tape formed from a plastic film having a magnetizable coating deposited thereon.
Figure 2:
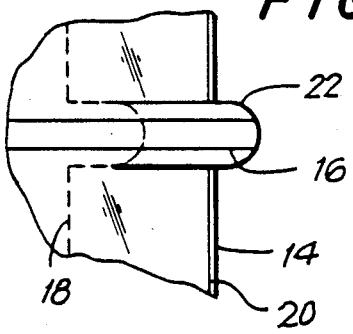
FIG. 2 is an enlarged fragmentary view of the package shown in FIG. 1 illustrating the magnetic tear tape adhered to the plastic film in which the package is wrapped.

The above objects and advantages can be attained in a relatively simple but effective manner in accordance with the present invention. FIG. 1 shows a cigarette pack 10 which may comprise, for example, a standard flip-top box 12 overwrapped with a thin transparent material 14 such as polypropylene film. A tear strip 16 bearing the magnetizable coating may be adhered to the film material 14. The film material 14 may be applied to the box 12 by aligning the leading end 18 of the film material with one side of the box 12 and then wrapping the film material 14 around the box 12 until it overlaps the leading edge 18 of the film material. (See FIG. 2) The film material 14 is then severed to form a trailing edge 20 and tab 22. The film material 14 is sealed between the leading edge 18 and the trailing edge 20 and the end flaps 24 and 26 on each end of the box 12 folded over and sealed.

Tear strip 16 is formed from a plastic substrate material containing a coating of magnetizable metal oxide and typically is between 1/16" and ⅛" wide. While ordinary magnetic recording tape slit to the desired width may be used, it is preferable to print (i.e., overcoat) the tape or laminate the tape to a colored or printable film or paper strip so that the appearance of the tape harmonizes or contrasts with the package graphics. It will be appreciated that with ordinary magnetic recording tape it is relatively easy to distinguish between the oxide coated surface of the tape and the uncoated surface of the tape. However, when additional coatings or laminations are applied to the oxide coated tape it may become more difficult to distinguish between the surfaces of the tape. Moreover, there is always the risk that the tear strip 16 may be misoriented with respect to the box 12 or the transparent material 14 and this risk increases as the tape is made narrower. For this reason, it is preferable to provide any additional coatings on both sides of the oxide coated substate so that the tear strip is reversible and therefore insensitive to its orientation with respect to the transparent film material. It will be appreciated that when the tape is reversible because a colored or printed lamina is disposed outwardly from the magnetic oxide coating, the tape will appear visually the same regardless of its orientation with respect to the package or wrapping material. Where the tape is symmetrical with respect to the oxide coating or coatings, the response to a magnetic read or write head will be the same regardless of the orientation of the tape. This feature is of particular value since a difference in signal strength may then be correlated with a misalignment of the tape or a defect in the magnetic read or write heads, for example.

Figure 3:
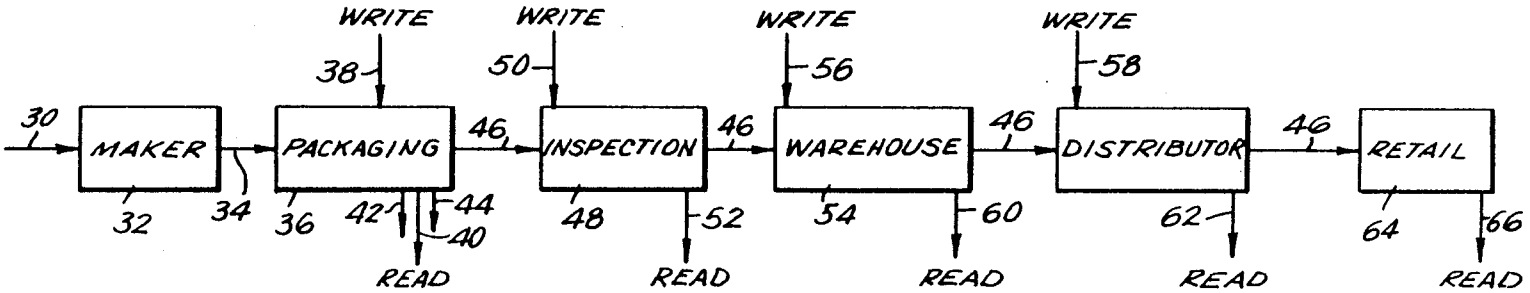
FIG. 3 is a block diagram indicating the location of possible "write" and "read" stations at various points in the life of a packaged consumer product such as cigarettes.
Figure 5P:
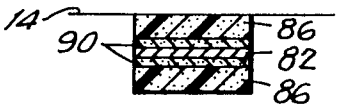
FIGS. 5(*a*)–5(*q*) illustrate, schematically, variations of the-present invention when applied as a tear tape or sealing strip.
Figure 5Q:
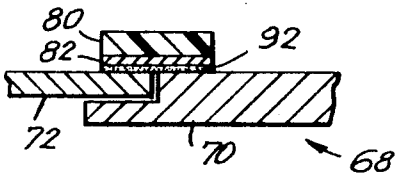
Figure 5A:
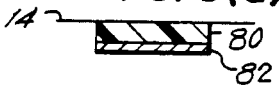
Figure 5B:
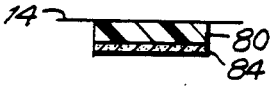
Figure 5C:
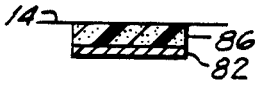
Figure 5D:
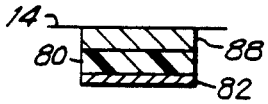
Figure 5E:
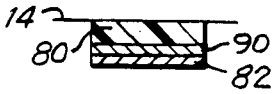
Figure 5F:
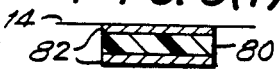
Figure 5G:
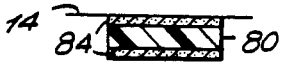
Figure 5H:
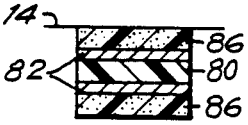
Figure 5I:
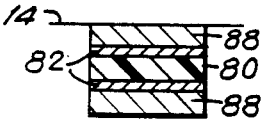
Figure 5J:
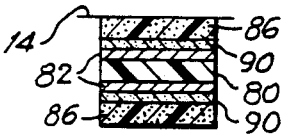
Figure 5K:
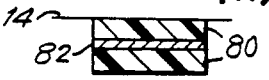
Figure 5L:
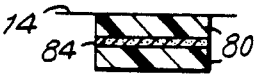
Figure 5M:
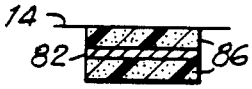
Figure 5N:
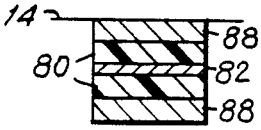
Figure 5O:
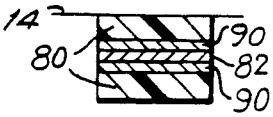

Referring to FIG. 3, cut tobacco filler 30 enters the maker 32 and is formed into cigarettes therein. Cigarettes 34 leave the maker 32 and enter a packaging machine 36 where they are placed in individual packs or boxes 12 and each pack or box wrapped with film material 14. Before the tear strip 16 is applied to the film material 14, a writing head (like writing head 38) may be aligned with the magnetic tear strip and the desired information encoded prior to feeding the strip 16 into the packaging machine 36. Alternatively, a writing head 38 may be located on the packaging machine 36 so as to be aligned with the tear strip 16 of each finished package and the desired information encoded on the magnetic tear strip 16 as the completed package passes the writing head 38. The desired information may include, for example, the identity of the cigarette maker 32, the brand of cigarette and the time, date and location of manufacture. If desired, a magnetic read-only head may be located at the delivery end of the packaging machine 36 and aligned with the proper location of the tear strip 16. Detection by the read-only head 40 of the signal encoded by the write head 38 indicates not only that the desired information was recorded on the tear strip 16 but also that the wrapping step was properly accomplished since the tear strip 16 appeared at the proper location. It may be desirable to employ supplemental read-only heads 42 and 44 spaced on each side of read-only head 40 so that, by comparing the relative strengths of the signals detected by read-only heads 40, 42 and 44, the precise location of the tear strip 16 can be established.

The packaged cigarettes 46 may enter an inspection station 48 provided with a magnetic write head 50 and read-only head 52. Thereafter, as the packaged cigarettes 46 respectively pass through the warehouse 54 and the distributor 56, additional information can be encoded on the magnetic tear strip 16 by magnetic write heads 56 and 58 and information obtained from the read-only heads 60, 62.

At the retail location 64, a portable read-only device 66 may be employed to evaluate the retailer's inventory of packaged product with respect, for example, to source, date of manufacture, and other information previously encoded on the magnetic tear strip 16 of the package 12.

It will be appreciated that the ability to code information on the package tear strip 16 provides a basis for future quality control procedures and inventory control procedures at the manufacturing, distributing and retailing levels without destroying or damaging any of the product. Moreover, since the magnetically encoded information is not visible, it will not be accessible except to authorized persons equipped with appropriate magnetic read-only devices.

Although the above description relates primarily to packaging of cigarettes, it will be appreciated that the same principles may be applied to various consumer products which may be wrapped with a film material or merchandised in plastic bags. Moreover, while the magnetizable tape is well suited as a tear strip or tear tape, the magnetizable tape may be adhered directly to the package so as to function as a seal.

Figure 4:
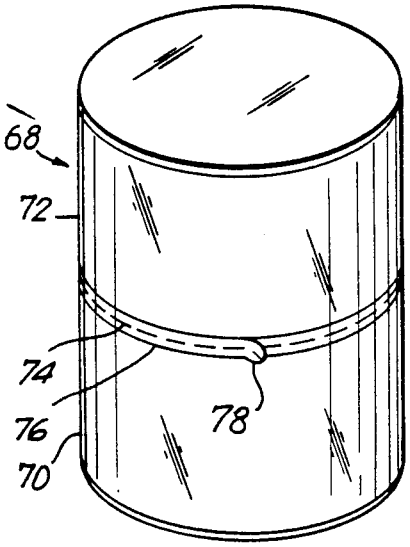
FIG. 4 is a perspective view of another form of package wherein the magnetic sealing strip is adhered directly to the package and performs a sealing function.

Referring to FIG. 4, a package 68 which is generally cylindrical in shape is illustrated. The package 68 may comprise a bottom portion 70 and a top portion 72 which are in telescoping relationship and meet along a circumferential line 74. Magnetic tape 76 may be affixed to cover the line 74 by an appropriate adhesive applied to the tape or forming a part of the tape. Preferably, the end of the tape 76 may be folded over upon itself to form a tab 78 which may facilitate opening of the package 68. Desired information may be written magnetically on the tape and read at a subsequent time. It will be appreciated that, as with the package of FIG. 1, the magnetically encoded information on the tape 76 may be used for a variety of purposes including the fact that the tape has been properly applied to seal the package. It will also be appreciated that packages of various sizes and shapes may be sealed by an adhesive-coated magnetic tape, including standard cardboard cartons. For such purposes, a relatively wide adhesive-coated magnetic tape or a composite tape including a magnetic strip may be employed.

The tear strip or sealing strip in accordance with the present invention may comprise a substrate upon which the magnetic medium, e.g., a metallic oxide, is coated. Where it is desired to alter the usual reddish brown or black color of the magnetic medium, pigments or coatings may be applied to or incorporated in the magnetic medium, or a conventional colored strip may be laminated to the oxide coated side or to the opposite side of the strip or to both sides to provide the desired color. Where the substrate is a plastic film material which is not readily printable, a printable graphics medium, e.g., paper or a printable plastic film may be laminated to the substrate on either the coated or the uncoated side thereof or on both sides thereof. The printable graphics medium may then be printed with a color, a design, a printed bar code or an alphanumeric inscription or any combination thereof as may be desired. When used as a sealing strip, an adhesive is applied to the strip or to the package so as to adhere the strip to the package. It will therefore be appreciated that the tear strip or sealing strip may be designed to enhance the package graphics while still providing its dual packaging and information storage functions. Of course, where a laminated or printed structure is employed, some degradation in writing resolution may occur. However, the writing density of the information required in the present application is substantially below that employed in the normal audio, video or computer applications of magnetic tape materials so that any degradation which may occur does not affect the information storage function of the present invention.

The variations in the constructions described above are shown in FIGS. 5(*a*)–5(*p*) as applied to a tear strip application. As indicated in exemplary form in FIG. 5(*q*), each of the strip constructions shown in FIGS. 5(*a*)–5(*p*) may also be utilized in a sealing strip application. FIG. 5(*q*) for a sealing strip application corresponds to FIG. 5(*a*) for a tear strip application wherein an adhesive is applied to the package or to the strip so as to adhere the strip to the package.

FIGS. 5(*a*)–5(*e*) illustrate variations in structure for a magnetic tape laminated to the thin transparent film material 14. In FIG. 5(*a*) the clear plastic substrate 80 is laminated on one side to the film material 14 and coated on the other side with a layer of magnetizable material 82 such as a metal oxide. The substrate 80 and magnetizable coating 82 may be a standard magnetic tape of the type used for audio, video or computer applications but slit to the desired width for use as a tear strip. The desired widths may be on the order of 1/16" to ⅛". If desired, the magnetic tape may be turned over so that the coated side 82 is laminated to the film material 14.

FIG. 5(*b*) illustrates a construction similar to FIG. 5(*a*) but in which a pigment is mixed with the magnetizable material to provide a coating 84 which has a predetermined color other than the usual reddish brown or black color associated with the metal oxides commonly employed for magnetic tape. As with the construction of FIG. 5(*a*), the tape strip may be reversed so that the coating 84 is laminated to the film material 14.

Another method of achieving a colored tear strip is illustrated in FIG. 5(*c*) wherein the substrate 86 of the magnetic tape is a colored plastic material which is then coated on one side with magnetizable material 82 and laminated on the other side to the film material 14. It will be appreciated in this instance that if the tape should be reversed so that the magnetizable coating 82 is laminated to the film material 14 the color of substrate 86 may not be visible from the outside of the wrapped article. To compensate for this effect, however, the surface of coating 82 facing toward the film material 14 may be colored to look like substrate 86, either by coating that surface (cf. FIG. 5(*b*)) or by providing an additional layer having the same appearance as substrate 86 (cf. FIG. 5(*m*) discussed below).

In some cases it may be desired to print designs or alphanumeric characters or symbols on the magnetic tape with or without a colored background. Since the substrate 80 may comprise a plastic material which is not readily printable, the structure shown in FIG. 5(*d*) is provided wherein a printable layer 88 is laminated to the substrate 80 or a pigment coating is applied to or produced on the substrate 80 so that the tape comprising the substrate 80, layer 88 and the magnetizable coating 82 may be printed or overcoated prior to laminating the tape to the film material 14. Again, if the tape of FIG. 5(*d*) should be reversed so that the magnetizable coating 82 is laminated to the film material 14 the effect of the color or printing will not be visible in the finished package unless additional steps are taken as described above in connection with FIG. 5(*c*).

As an alternative to the construction of FIG. 5(*d*), the construction of FIG. 5(*e*) may be employed wherein a metallized coating 90 is deposited on the substrate 80 which can be colored or colorless. The metallized coating 90 may be applied by the wellknown vacuum deposition process. The magnetizable coating 82 is then placed on the coating 90, and the finished tape laminated to the film material 14.

In the embodiments of FIGS. 5(*a*)–5(*e*), if the tape is reversed or turned over, with respect to the film material 14, the distance between the magnetizable coating 82 and the surface of the film material 14 will be altered. This, in turn, will modify the strength of the magnetic signal recorded on the tape and the strength of the signal subsequently retrieved from the tape. To avoid this condition, it may be desirable to utilize symmetrical tape constructions as shown in FIGS. 5(*f*)–5(*j*) employing two magnetizable coatings.

In FIG. 5(*f*), a coating of magnetizable material 82 is applied to each surface of the substrate 80 prior to lamination of the tape to the film material 14. As the tape is symmetrical about its substrate 80, both its appearance and magnetic characteristics will be independent of its orientation with respect to the film material 14.

In FIG. 5(*g*), a coating of magnetizable material containing pigment 84 is applied to each surface of the substrate 80 prior to lamination of the tape to the film material 14 thereby producing a symmetrical structure similar to that of FIG. 5(*b*).

As shown in FIGS. 5(*h*) and 5(*i*) magnetizable coatings 82 are applied to each side of the substrate 80 and then further coatings or lamina are applied to create symmetrical structures. In FIG. 5(*h*) the outer lamina are colored films or layers 86 while in FIG. 5(*i*) the outer lamina are printable or printed layers 88. FIG. 5(*j*) shows a configuration similar to FIG. 5(*h*) but having in addition to a magnetizable coating 82 applied to each side of the substrate 80 and a layer 86 of transparent colored film, a metallized coating 90 applied to layer 86. It will be observed that the structures shown in FIGS.

5(*f*)–5(*j*) are reversible and have the same magnetic and-optical properties in both orientations.

In FIGS. 5(*k*)–5(*o*) the tape constructions are symmetrical about the single magnetizable coating 82 instead of the substrate 80. Thus, in FIG. 5(*k*) after the magnetizable coating 82 is applied to the substrate 80, a second substrate 80 is laminated to the magnetizable coating 82 to provide a reversible tape having the magnetizable coating 82 in the middle. The construction of FIGS. 5(*l*) through 5(*o*) are accomplished in a similar manner. The tear tapes of FIGS. 5(*l*) and 5(*m*) provide a colored appearance due, respectively, to the pigmented magnetic coating 84 (FIG. 5(*l*)) and the colored substrate 86 (FIG. 5(*m*)) while the tear tape of FIG. 5(*n*) may feature a pigmented and/or printed appearance due to the printable layer 88. The tape of FIG. 5(*o*) features a metallized appearance due to the metallized coating 90. As shown in FIG. 5(*p*), by using a colored substrate 86 and the metallized coating 90, a colored metallic appearance may be produced.

The sealing strip in accordance with the present invention is like the tear strip but is adhered directly to the exterior surface of a carton or package instead of being laminated to a thin film material. This means, of course, that while the visible side of the tear strip is laminated to the thin film material, the opposite side of the sealing strip is adhered to the package. It will be appreciated, therefore, that each of the tear strip constructions illustrated in FIGS. 5(*a*)–5(*p*) may become a sealing strip construction by applying adhesive to the surface opposite the surface laminated to the film material 14 and eliminating the film material 14. This is exemplified by FIG. 5(*q*) which illustrates a tape having a substrate 80-and a magnetizable coating 82 (similar to the construction of FIG. 5(*a*)) and adhered to a carton 68 comprising telescoping sections 70, 72 by an adhesive layer 92. As the advantages of reversibility and uniform magnetic properties apply equally to the tear strip and sealing strip applications, it will be apparent that each of the constructions of FIGS. 5(*a*)–5(*p*) may be used as a sealing strip.

The terms and expressions which have been employed are used as terms of description and not of limitation and there is no intention in the use of such terms and expressions of excluding any equivalents of the features shown and described or portions thereof, but it is recognized that various modifications are possible within the scope of the invention claimed.

What is claimed is:

1. A package comprising a carton or container overwrapped with thin, flexible sheet packaging material, said sheet material comprising a tear tape having at least one substrate strip coated on at least one side with a magnetizable metal oxide material carrying magnetically coded information, said tear tape laminated to said sheet of thin flexible packaging material.

2. A package as described in claim 1 wherein said sheet of flexible packaging material is a plastic film material.

3. A package as described in claim 2 wherein pigment is combined with said magnetizable metal oxide material.

4. A package as described in claim 2 wherein said substrate strip is colored.

5. A package as described in any one of claims 1, 2, 3 or 4 wherein the package comprises a cigarette package.

6. A package as described in claim 1 and further comprising at least one strip of material capable of receiving printed graphics laminated on at least one side of said tear tape, one said strip of material capable of receiving printed graphics laminated to said sheet of flexible packaging material.

7. A package as described in claim 6 wherein said sheet of flexible packaging material is a plastic film material.

8. A package as described in claim 1, having a coating of magnetizable metal oxide material on one side of said substrate strip, and a second substrate strip symmetrically disposed with respect to said coating.

9. A package as described in claim 8 wherein said sheet of flexible packaging material is a plastic film material.

10. A package as described in claim 1, having a first coating of magnetizable metal oxide material applied to said substrate strip and a second coating of magnetizable metal oxide material applied to the opposite side of the substrate strip.

11. A package as described in claim 10 having strip material capable of receiving printed graphics laminated on each of said coatings, one of said strips laminated to said sheet of flexible packaging material.

12. A package as described in claim 1 and further comprising a metallized coating on at least one side of said tear tape.

13. A package comprising a carton or container overwrapped with thin, flexible sheet packaging material, said sheet material having laminated thereto a tear tape comprising a first substrate strip formed from a plastic material and having deposited thereon a first metallized coating, a coating of magnetizable metal oxide material carrying magnetically coded information and a second metallized coating, and a second substrate strip formed from a plastic material laminated to said second metallized coating.

14. A package comprising a carton or container having adjacent parts defining a closure wherein said adjacent parts are sealed together by a removable tape comprising at least one substrate strip coated on at least one side with a magnetizable metal oxide material carrying magnetically coded information and having an adhesive layer located on the surface of said tape which engages said adjacent parts defining a closure.

15. A package as described in claim 14 wherein a pigment is combined with said magnetizable metal oxide material.

16. A package as described in claim 14 wherein said substrate strip is colored.

17. A package as described in claim 14 and further comprising at least one strip of material capable of receiving printed graphics laminated to said removable tape.

18. A package as described in claim 17 wherein said strip of material capable of receiving printed graphics is coated with a pigment.

19. A package as described in claim 14 having a coating of magnetizable metal oxide material on one side of said substrate strip and a second substrate strip symmetrically disposed with respect to said coating.

20. A package as described in claim 14 having a first coating of magnetizable metal oxide material applied to said substrate strip and a second coating of magnetizable metal oxide material applied to the opposite side of said substrate strip.

21. A package as described in claim 20 having strip material capable of receiving printed graphics laminated on each of said coatings, one of said strips having said adhesive layer located thereon for sealingly engaging said adjacent parts defining a closure.

22. A package as described in claim 14 and further comprising a metallized coating on at least one side of said removable tape.

23. A package comprising a carton or container having adjacent parts defining a closure wherein said adjacent parts are sealed together by a removable tape comprising a first substrate strip formed from a plastic material and having deposited thereon a first metallized coating, a coating of magnetizable metal oxide material carrying magnetically coded information and a second metallized coating, a second substrate strip formed from a plastic material laminated to said second metallized coating and a coating of adhesive applied to one side of said removable tape.

* * * * *